US009333388B2

(12) United States Patent
Lee et al.

(10) Patent No.: US 9,333,388 B2
(45) Date of Patent: May 10, 2016

(54) DUAL-PURPOSE FOLDABLE TREADMILL

(75) Inventors: Sunny Lee, Tsao-Tun Chen (TW); Simon Chao, Tsao-Tun Chen (TW)

(73) Assignee: Superweigh Enterprise Co., LTD., Tsao-Tun Chen, Nan-Tou Hsien (TW)

( * ) Notice: Subject to any disclaimer, the term of this patent is extended or adjusted under 35 U.S.C. 154(b) by 335 days.

(21) Appl. No.: 13/552,076

(22) Filed: Jul. 18, 2012

(65) Prior Publication Data

US 2013/0203561 A1 Aug. 8, 2013

(51) Int. Cl.
*A63B 22/02* (2006.01)

(52) U.S. Cl.
CPC ..... *A63B 22/0235* (2013.01); *A63B 21/4029* (2015.10); *A63B 2210/50* (2013.01)

(58) Field of Classification Search
CPC ..... A63B 22/02; A63B 22/0235; A63B 21/1457; A63B 2210/50; A63B 2210/56; A63B 21/00047; A63B 21/00087; A63B 21/078
USPC ..... 482/51, 54, 142, 148, 907; 119/700
See application file for complete search history.

(56) References Cited

U.S. PATENT DOCUMENTS

| | | | | |
|---|---|---|---|---|
| 5,868,648 | A * | 2/1999 | Coody et al. | 482/54 |
| 6,520,894 | B1 * | 2/2003 | Mesloh | 482/148 |
| 6,695,751 | B1 * | 2/2004 | Hsu | 482/54 |
| 7,645,214 | B2 * | 1/2010 | Lull | 482/51 |
| 7,819,779 | B2 * | 10/2010 | Chang | 482/54 |
| 2004/0005961 | A1 * | 1/2004 | Iund et al. | 482/54 |
| 2006/0247109 | A1 * | 11/2006 | Powell | 482/148 |
| 2008/0280734 | A1 * | 11/2008 | Dickie et al. | 482/54 |
| 2009/0124466 | A1 * | 5/2009 | Zhang | 482/54 |
| 2009/0163327 | A1 * | 6/2009 | Huang et al. | 482/54 |
| 2013/0123073 | A1 * | 5/2013 | Olson et al. | 482/54 |

* cited by examiner

*Primary Examiner* — Loan H Thanh
*Assistant Examiner* — Gregory Winter
(74) *Attorney, Agent, or Firm* — LeClairRyan

(57) ABSTRACT

A dual-purpose foldable treadmill includes a drive unit, a base frame, an arm frame, a cantilever panel and a tread frame. The arm frame extends in an upright direction from a wall of the base frame and terminates at a top joining end. The cantilever panel extends transversely from the top joining end. The tread frame is pivotally connected to and foldable relative to the base frame such that a lengthwise line of the tread frame is parallel to the upright direction of the arm frame in the folded position. The folded treadmill can be used as a piece of furniture for storage or as a bench.

11 Claims, 7 Drawing Sheets

DUAL-PURPOSE FOLDABLE TREADMILL

BACKGROUND OF THE INVENTION

1. Field of the Invention

This invention relates to a treadmill, more particularly a dual-purpose foldable treadmill.

2. Description of the Related Art

A conventional treadmill as shown in FIG. 1 includes a supporting frame 11, a control panel 12, and a track bed 13. The supporting frame 11 has the control panel 12 mounted thereon and has opposite lower ends connected to the track bed 13. In general, handrails are disposed respectively on both sides of the supporting frame 11 for gripping by a user when running or walking on the treadmill.

Due to the bulkiness of conventional treadmills, storage or transportation thereof is a major problem. Another problem with conventional treadmills is that they are relatively expensive exercise equipment designed for only one specific purpose. Thus it is desirable to have a treadmill that can be stored in limited space and provide functions other than acting as exercising equipment.

SUMMARY OF THE INVENTION

Therefore, an object of the present invention is to provide a dual-purpose foldable treadmill that can be used as exercising equipment or a piece of furniture.

Accordingly, a dual-purpose foldable treadmill of the present invention comprises a drive unit, a base frame, an arm frame, a cantilever panel, and a tread frame.

The base frame is configured to permit the drive unit to be mounted therein, and extends in a transverse direction to terminate at first and second end walls. The base frame has a rear marginal zone which extends between the first and second end walls.

The arm frame includes a base segment which is disposed to flank the second end wall, and an arm body which extends from the base segment in an upright direction to terminate at a top joining end.

The cantilever panel extends from the top joining end in the transverse direction and over the base frame to terminate at a cantilevered end.

The tread frame includes front and rear marginal regions which are opposite to each other, and defines a lengthwise line extending from the front marginal region to terminate at the rear marginal region. The front marginal region is pivotably mounted on the rear marginal zone about a pivot axis that is oriented in the transverse direction such that the rear marginal region is turnable between an unfolded position, where the lengthwise line of the tread frame is transverse to both the upright and transverse directions, and a folded position, where the lengthwise line of the tread frame is parallel to the upright direction.

The dual-purpose foldable treadmill provided by the present invention can be conveniently folded to save storage space and, in the folded position, can be used as a piece of furniture for placement or storage of objects or for sitting.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
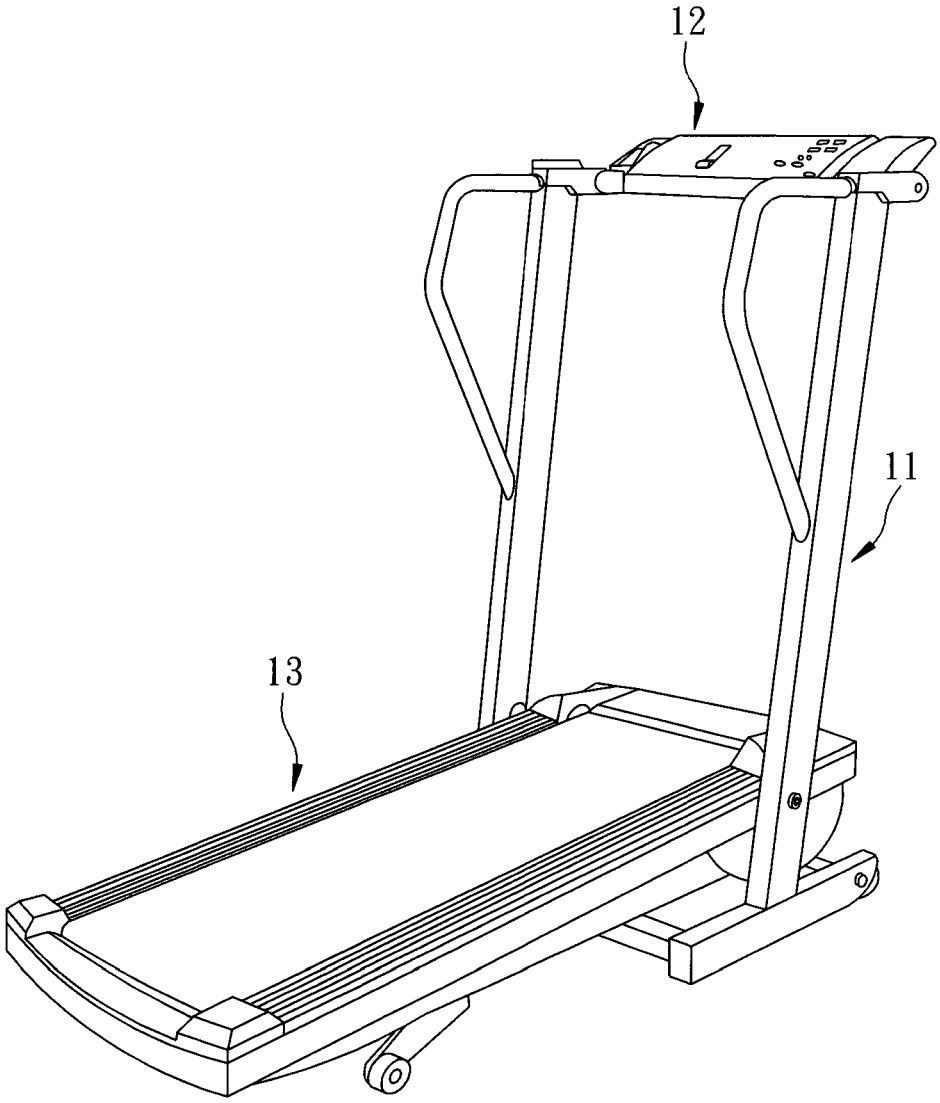
FIG. 1 PRIOR ART
FIG. 1 is a perspective view of a conventional treadmill.
Figure 2:
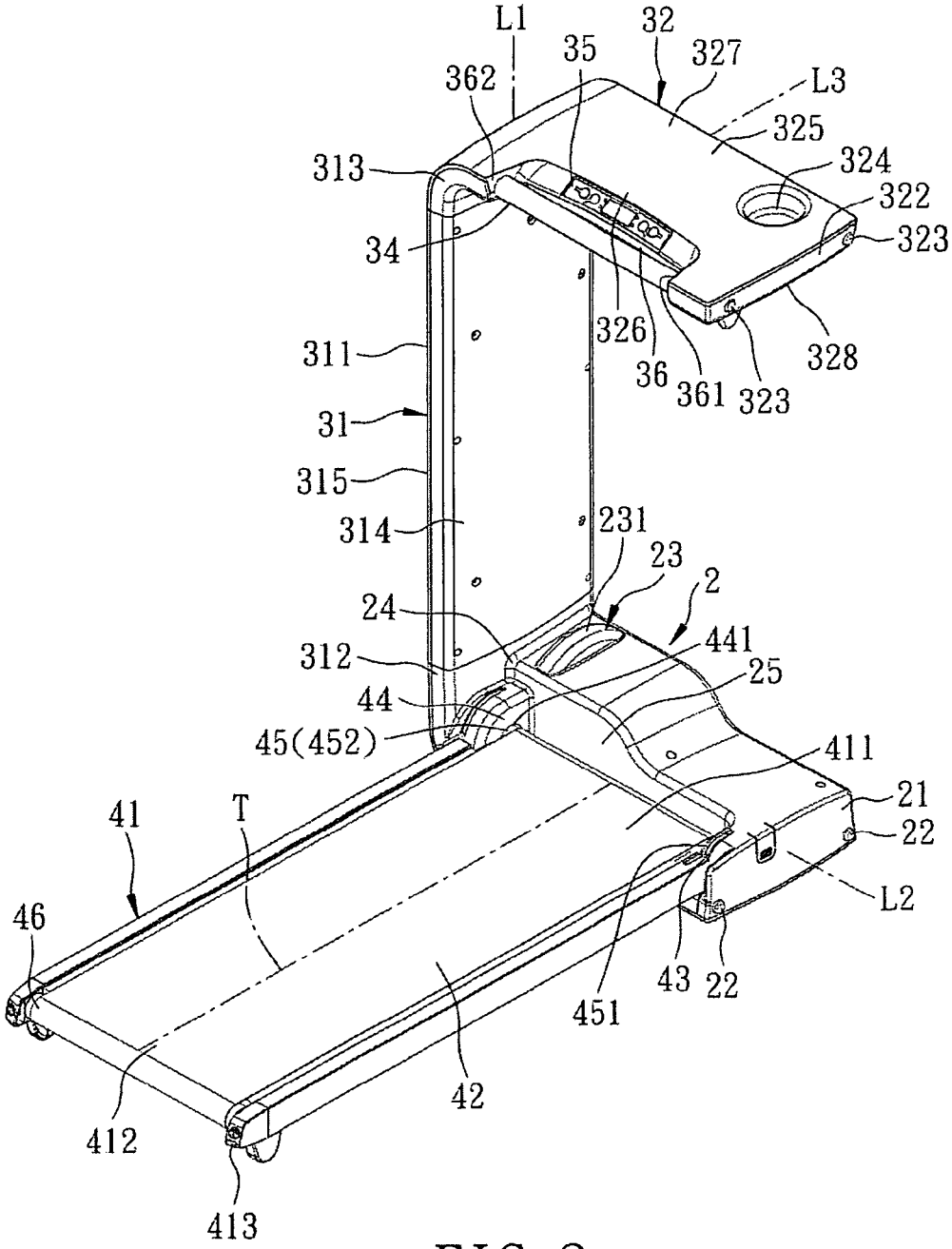
FIG. 2 is a perspective elevational view of a preferred embodiment according to the present invention in an unfolded position where a user may walk or run thereon.
Figure 3:
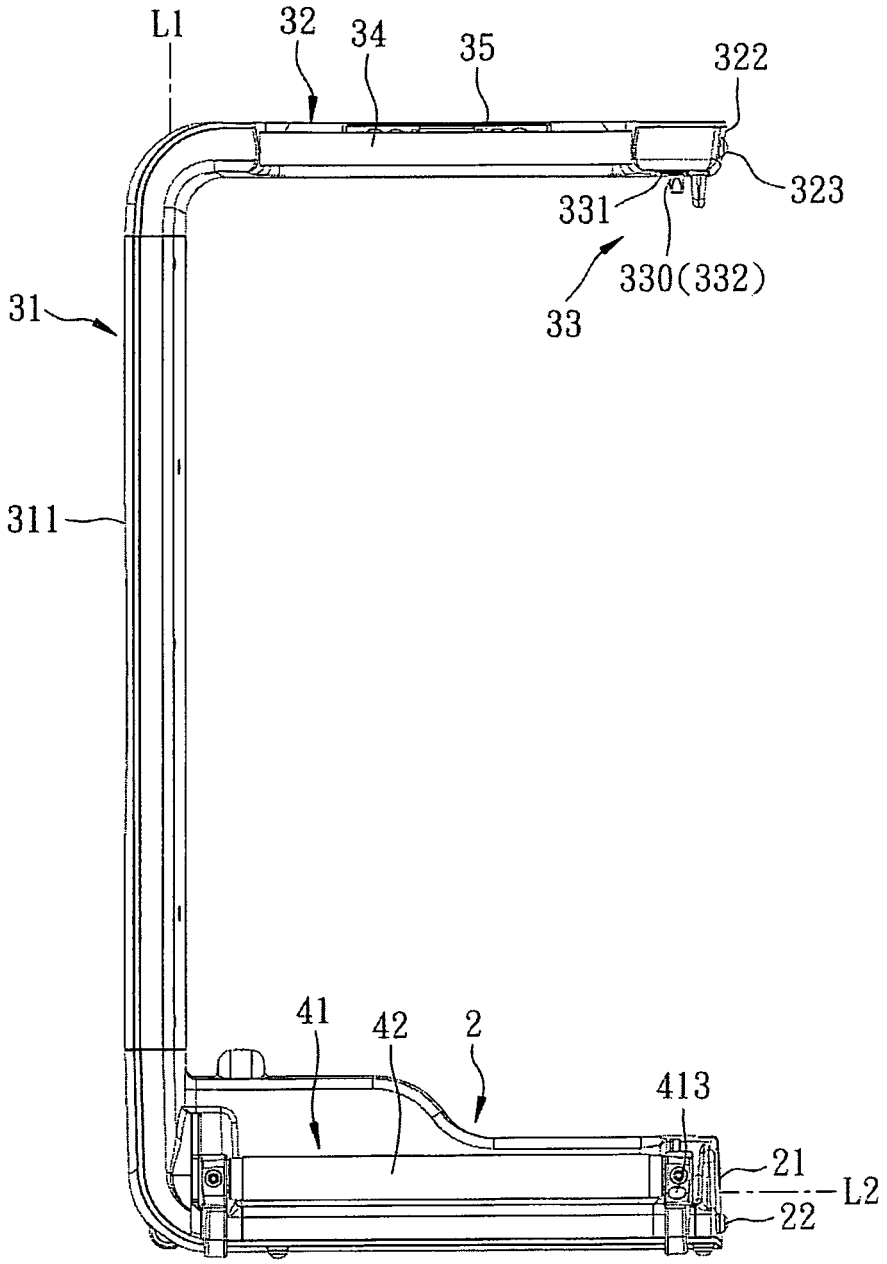
FIG. 3 is an elevational side view of the preferred embodiment shown in FIG. 2.
Figure 4:
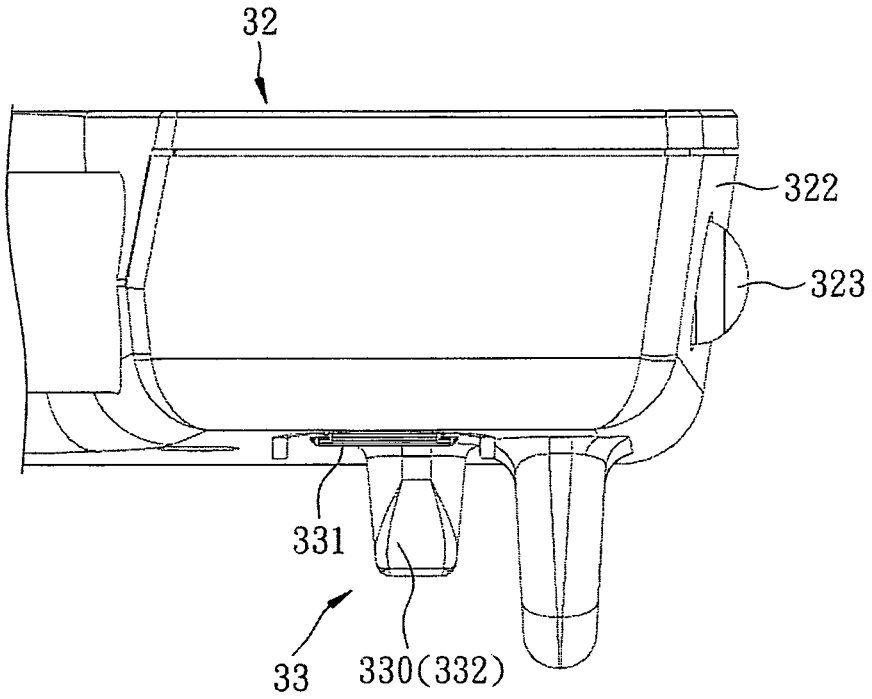
FIG. 4 is a schematic partial view of the preferred embodiment showing a plug member disposed on the cantilever panel.

Referring to FIGS. 2, 3 and 4, a preferred embodiment of a dual-purpose foldable treadmill according to the present invention is shown to comprise a drive unit 23, a base frame 2, an arm frame 31, a cantilever panel 32, and a tread frame 41.

The drive unit 23 includes a drive-force transmission wheel 231 coupled to an output shaft or a motor (not shown) so as to provide a drive force for the treadmill.

The base frame 2 is configured to permit the drive unit 23 to be mounted therein, and extends in a transverse direction (L2) to terminate at first and second end walls 21, 24. The base frame 2 has a rear marginal zone 25 which extends between the first and second end walls 21, 24.

The arm frame 31 includes a base segment 312 which is disposed to flank the second end wall 24, and an arm body 311 which extends from the base segment 312 in an upright direction (L1) to terminate at a top joining end 313. The arm body 311 has inward and outward surfaces 314, 315 which are respectively proximate to and distal from the second end wall 24 of the base frame 2.

The cantilever panel 32 extends from the top joining end 313 of the arm frame 31 in the transverse direction (L2) and over the base frame 2 to terminate at a cantilevered end 322. The cantilevered end 322 is aligned with the first end wall 21 of the base frame 2 in the upright direction (L1).

The cantilever panel 32 includes a front portion 325 and a rear portion 326 which are opposite to each other in a longitudinal direction (L3) that is transverse to both the upright direction (L1) and the transverse direction (L2), and has an upward surface 327 and a downward surface 328 which are opposite to each other in the upright direction (L1). The cantilever panel 32 further has a depression 324 provided therein for holding an object.

The tread frame 41 includes front and rear marginal regions 411, 412 which are opposite to each other, and defines a lengthwise line (T) extending from the front marginal region 411 to terminate at the rear marginal region 412. The front marginal region 411 is pivotably mounted on the rear marginal zone 25 of the base frame 2 about a pivot axis that is oriented in the transverse direction (L2) such that the rear marginal region 412 is turnable between an unfolded position, where the lengthwise line (T) of the tread frame 4 is transverse to both the upright direction (L1) and the transverse direction (L2), and a folded position, where the lengthwise line (T) of the tread frame 4 is parallel to the upright direction (L1).

The tread frame 41 further includes front and rear rollers 45, 46 which are respectively journalled on the front and rear marginal regions 411, 412 so as to be rotatable respectively about front and rear rolling axes that are parallel to the pivot axis. The front roller 45 is coupled with the drive unit 23 so as to be driven thereby. An endless belt 42 is disposed to be entrained about the front and rear rollers 45, 46.

Specifically, the rear marginal zone 25 has first and second bearing areas 43, 44 which are respectively adjacent to the first and second end walls 21, 24. The front roller 45 is configured to have first and second front journal ends 451, 452 which are respectively journalled on the first and second bearing areas 43, 44.

Figure 5:
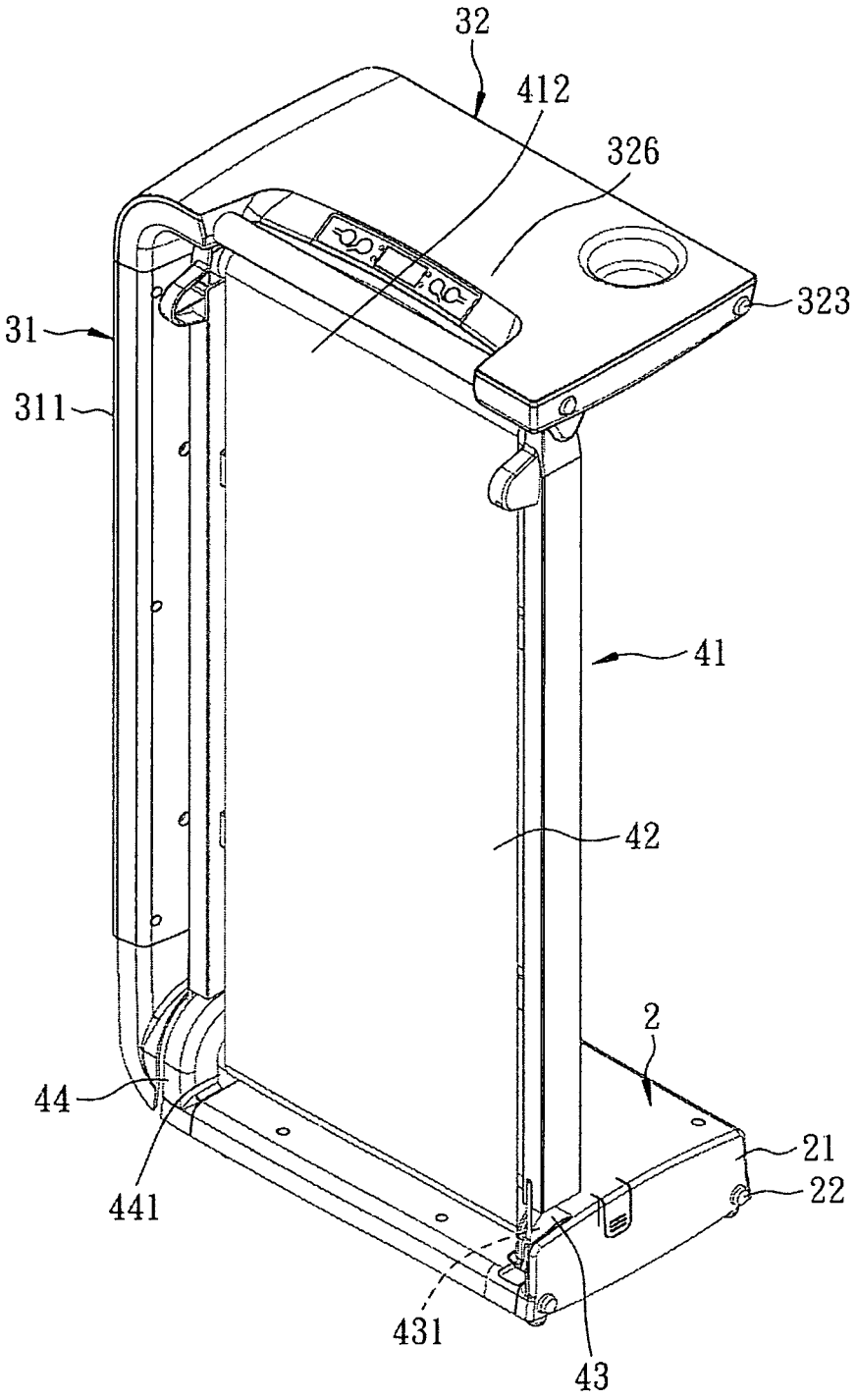
FIG. 5 is another perspective elevational view of the preferred embodiment in the folded position.

As shown in FIGS. 2 and 5, the first and second bearing areas 43, 44 are in the form of lugs which respectively define first and second inner tubular surfaces 431, 441 to surround the pivot axis such that the front rolling axis is in line with the pivot axis, thereby permitting the first and second front journal ends 451, 452 to be journalled on the first and second inner tubular surfaces 431, 441 of the first and second lugs 43, 44, respectively.

Figure 6:
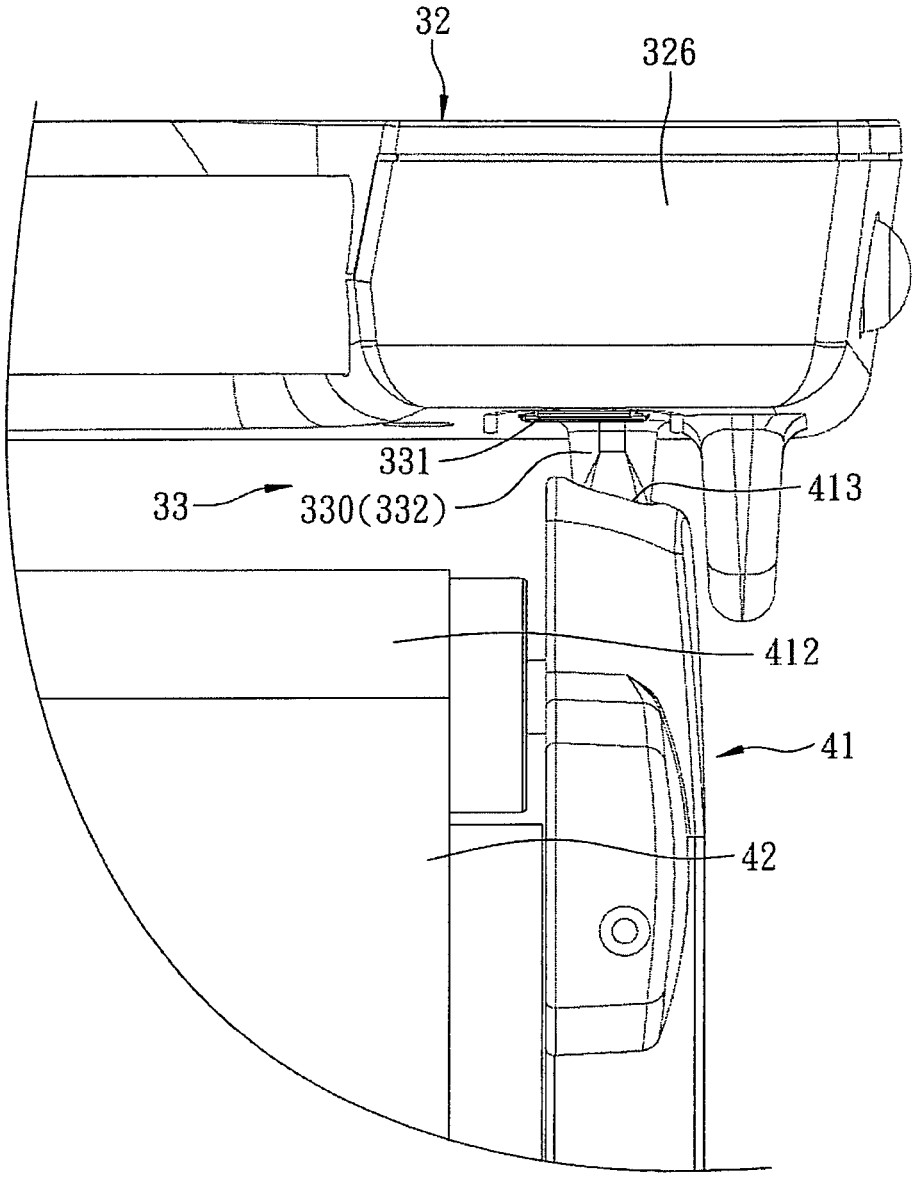
FIG. 6 is another schematic partial view of the preferred embodiment in the folded position, showing engagement between a plug end of the plug member and a socket member.

A locking unit 33 is disposed to lock the rear marginal region 412 of the tread frame 41 to the rear portion 326 of the cantilever panel 32 so as to lock the rear marginal region 412 in the folded position (see FIGS. 5 and 6).

Referring to FIGS. 3, 4 and 6, the locking unit 33 includes a plug member 330 which includes a deformable base end 331 disposed on and deformable inwardly of the downward surface 328, and a plug end 332 extending downwardly from the deformable base end 331, and which is disposed proximate to the cantilevered end 322. A socket member 413 is disposed in the rear marginal region 412 of the tread frame 41. Once the rear marginal region 412 comes into contact with the plug end 332 during displacement to the folded position, the plug end 332 is pressed to move the deformable base end 331 to a deformed position so as to permit the plug end 332 to be trapped in the socket member 413, thereby locking the rear marginal region 412 in the folded position.

Referring further to FIG. 2, the rear portion 326 of the cantilever panel 32 has a cutout region 36 which extends in the transverse direction (L2) to terminate at first and second holding surfaces 361, 362 that are spaced apart from each other by a rear space. A crosspiece 34 is disposed to span the rear space to interconnect the first and second holding surfaces 361, 362. The crosspiece 34 may serve as a handgrip for a user.

A control panel body 35 is disposed on the cantilever panel 32 adjacent to the cutout region 36 and is electrically connected to the drive unit 23 for operation by the user to control the speed of the endless belt 42.

When the dual-purpose foldable treadmill is in the folded position as shown in FIG. 5, it can be used as apiece of furniture for placement or storage of objects, i.e., objects can be placed on the cantilever panel 32 or stored in a space formed between the cantilever panel 32 and the base frame 2.

Figure 7:
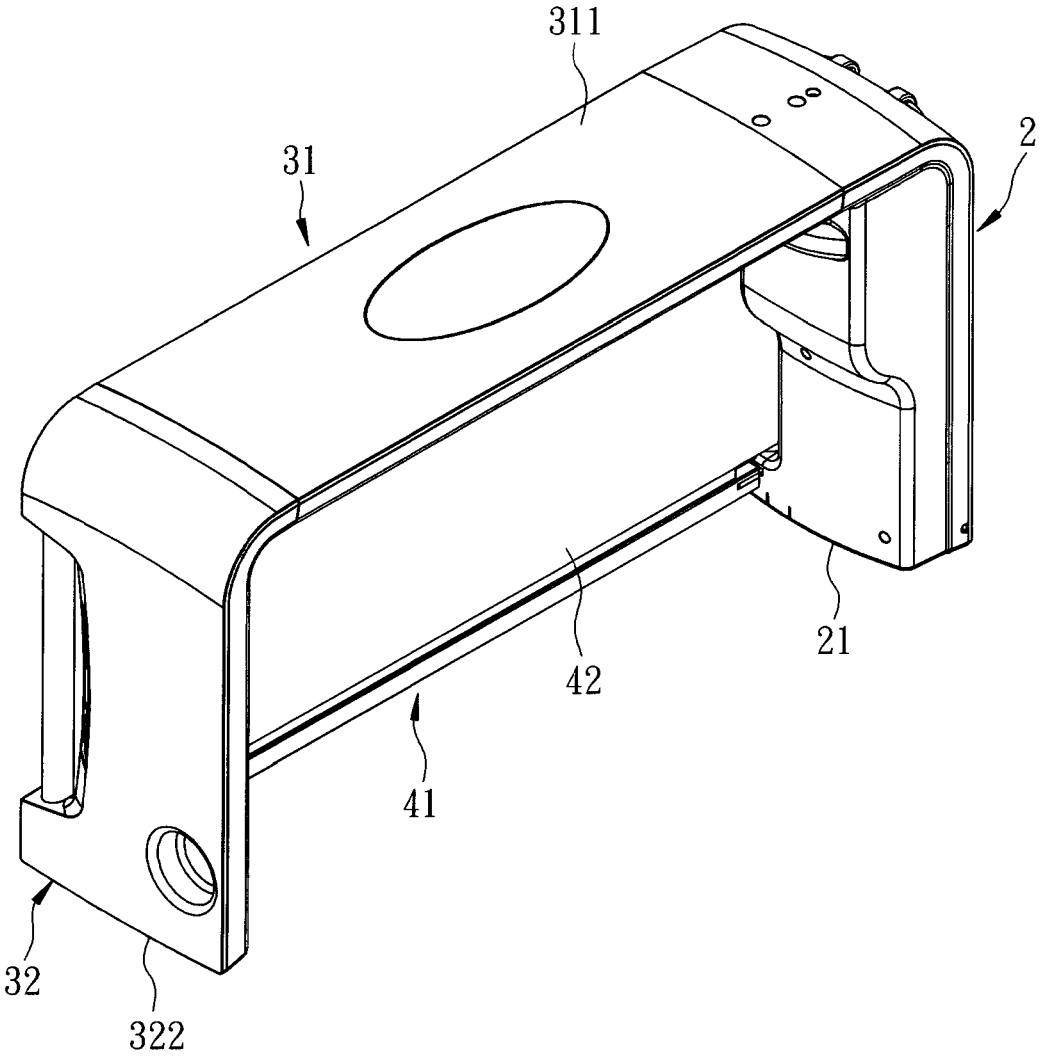
FIG. 7 is a perspective view of the preferred embodiment of the invention in the folded position to be used as a bench.

Referring to FIGS. 2 and 7, a pair of foot pads 323 are disposed on the cantilevered end 322 of the cantilever panel 32 and a pair of foot pads 22 are disposed on the first end wall 21 of the base frame 2 for resting on a floor surface. Thus, when the dual-purpose foldable treadmill is in the folded position and turned sidewise as shown in FIG. 7, it can be used as a piece of furniture, e.g., a bench.

Specifically, when the folded dual-purpose foldable treadmill is disposed such that the foot pads 22, 323 rest on the floor surface and the arm frame 31 is parallel to the floor surface with the outward surface 315 facing away from the floor surface, the outward surface 315 provides a sitting surface.

To summarize, the dual-purpose foldable treadmill according to the present invention has the following advantages:

1. The dual-purpose foldable treadmill can be easily folded to save storage space. Moreover, the folded treadmill can function as a piece of furniture for placement or storage of objects or for sitting.
2. The arrangement of the locking unit 33 permits convenient releasable locking engagement between the cantilever panel 32 and the tread frame 41.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A dual-purpose foldable treadmill for use on a floor surface, the treadmill comprising:

a drive unit;

a base frame which is configured to permit said drive unit to be mounted therein, and which extends in a transverse direction to terminate at first and second end walls, said base frame having a rear marginal zone which extends between said first and second end walls;

an arm frame including a base segment which is disposed to flank said second end wall, and an arm body which extends from said base segment in an upright direction to terminate at a top joining end, said arm body having an outward surface;

a cantilever panel extending from said top joining end in the transverse direction and over said base frame to terminate at a cantilevered end, said cantilever panel including a rear portion; and a tread frame including front and rear marginal regions which are opposite to each other, and defining a lengthwise line extending from said front marginal region to terminate at said rear marginal region, said front marginal region being pivotably mounted on said rear marginal zone about a pivot axis that is oriented in the transverse direction such that said rear marginal region is turnable between an unfolded position, where the lengthwise line is transverse to both the upright and transverse directions, and a folded position, where the lengthwise line is parallel to the upright direction;

whereby once said rear marginal region is turned to the folded position and said rear marginal region couples with said rear portion of said cantilever panel, said dual-purpose foldable treadmill can be used as a seating bench, with said arm frame being parallel to the floor surface and said outward surface of said arm body facing away from the floor surface, said arm body serving as a sitting surface.

2. The dual-purpose foldable treadmill as claimed in claim 1, further comprising:

a front roller and a rear roller which are respectively journalled on said front marginal region and said rear marginal region so as to be rotatable respectively about front and rear rolling axes that are parallel to the pivot axis, said front roller being coupled with said drive unit so as to be driven thereby; and an endless belt disposed to be entrained about said front and rear rollers.

3. The dual-purpose foldable treadmill as claimed in claim 2, wherein said rear marginal zone has first and second bearing areas which are respectively adjacent to said first and second end walls, said front roller being configured to have first and second front journal ends which are respectively journalled on said first and second bearing areas.

4. The dual-purposed foldable treadmill as claimed in claim 3, wherein said first and second bearing areas are in the form of lugs which respectively include first and second inner tubular surfaces that surround the pivot axis such that the front rolling axis is in line with the pivot axis to thereby permit said first and second front journal ends of said front roller to be journalled on said first and second inner tubular surfaces of said first and second lugs, respectively.

5. The dual-purpose foldable treadmill as claimed in claim 1, wherein said cantilever panel further includes a front portion in addition to said rear portion, said front portion and said rear portion being opposite to each other in a longitudinal direction that is transverse to both the upright direction and the transverse direction, and an upward surface and a downward surface which are opposite to each other in the upright direction, said dual-purpose foldable treadmill further comprising a locking unit which is disposed to lock said rear marginal region to said rear portion so as to lock said rear marginal region in the folded position.

6. The dual-purpose foldable treadmill as claimed in claim 5, wherein said locking unit includes a plug member which includes a deformable base end disposed on and deformable inwardly of said downward surface, and a plug end extending downwardly from said deformable base end, said plug member being disposed proximate to said cantilevered end, and a socket member which is disposed in said rear marginal region such that once said rear marginal region comes into contact with said plug end during displacement to the folded position, said plug end is pressed to move said deformable base end to a deformed position so as to permit said plug end to be trapped in said socket member, thereby locking said rear marginal region in the folded position.

7. The dual-purpose foldable treadmill as claimed in claim 1, wherein said cantilevered end is aligned with said first end wall of said base frame in the upright direction.

8. The dual-purpose foldable treadmill as claimed in claim 1, wherein said cantilever panel has a depression for holding an object therein.

9. The dual-purpose foldable treadmill as claimed in claim 5, wherein said rear portion has a cutout region which extends in the transverse direction to terminate at first and second holding surfaces that are spaced apart from each other by a rear space, said dual-purpose foldable treadmill further comprising a crosspiece which is disposed to span said rear space to interconnect said first and second holding surfaces.

10. The dual-purpose foldable treadmill as claimed in claim 9, further comprising a control panel body disposed in said cantilever panel adjacent to said cutout region and electrically connected to said drive unit.

11. The dual-purpose foldable treadmill as claimed in claim 5, further comprising a pair of foot pads disposed on said cantilevered end and a pair of foot pads disposed on said first end wall of said base frame for resting on the floor surface.

* * * * *